United States Patent [19]

Cary

[11] 4,290,729

[45] Sep. 22, 1981

[54] ANGULAR DETACHABLE EXTENSIONS TO THE FORKS OF FORK LIFT TRUCKS

[76] Inventor: Arthur P. Cary, 2519 Farrington St., Dallas, Tex. 75207

[21] Appl. No.: 962,552

[22] Filed: Nov. 20, 1978

[51] Int. Cl.[3] ..... B66F 9/06

[52] U.S. Cl. ..... 414/607; 414/785

[58] Field of Search ..... 414/592, 143, 607, 668, 414/678, 785, 608, 662, 663, 664; 403/306; 280/492

[56] References Cited

U.S. PATENT DOCUMENTS

| | | | |
|---|---|---|---|
| 2,068,825 | 1/1937 | Stevenson | 414/607 |
| 3,050,206 | 8/1962 | McCracken | 414/607 |
| 3,258,145 | 6/1966 | Costello | 414/607 |
| 3,850,322 | 11/1974 | Miles | 414/607 |
| 3,930,585 | 1/1976 | Lynch | 414/607 |

FOREIGN PATENT DOCUMENTS

| | | | |
|---|---|---|---|
| 267472 | 9/1968 | U.S.S.R. | 414/607 |
| 540816 | 1/1977 | U.S.S.R. | 414/607 |

*Primary Examiner*—Leslie J. Paperner
*Assistant Examiner*—Terrance L. Siemens

[57] ABSTRACT

This invention relates to fork lifts, and has as its object the provision of angular attachable extensions to the forks by means of which the operator can pick up or deposit loads at levels below that of the floor on which the fork lift is operating, as for example, from the ground or from the floor of a pickup truck which may be several feet below the warehouse floor.

4 Claims, 6 Drawing Figures

ANGULAR DETACHABLE EXTENSIONS TO THE FORKS OF FORK LIFT TRUCKS

SUMMARY OF THE PRESENT INVENTION

In most warehouses the dock level or elevation of the floor above ground is approximately 50 inches. This level corresponds to that of trucks and trailers from which fork lifts unload and into which they load merchandise. When the level of a large truck or trailer varies by a few inches from that of the warehouse floor, so-called dock boards of steel or other metal are used to form a temporary bridge between the two surfaces so that fork lifts, which may be powered or manually operated, can enter the vehicles. But it is often necessary to load or unload pickup and other small trucks, or low trailers, whose beds may be several feet below the level of the warehouse floor. Dock boards are useless in such cases because the fork lifts cannot climb the steep grades which would be involved, nor could the vehicles withstand the weight of the fork lift, which is usually measured in tons. As a result the loads must be manhandled, with ever present danger to personnel. My invention makes it unnecessary ever to handle loads manually, resulting in both speed and safety for the operation. This is accomplished by the provision of angular extensions to the forks, which, then attached to the forks and lowered to the desired level, can be placed under a pallet or other load, and then elevated to the level of the warehouse floor.

BRIEF DESCRIPTION OF THE DRAWINGS

FIG. 6 is a perspective view of the angular fork extensions when detached from the fork lift truck.

DESCRIPTION OF THE ILLUSTRATED EMBODIMENT

Figure 1:
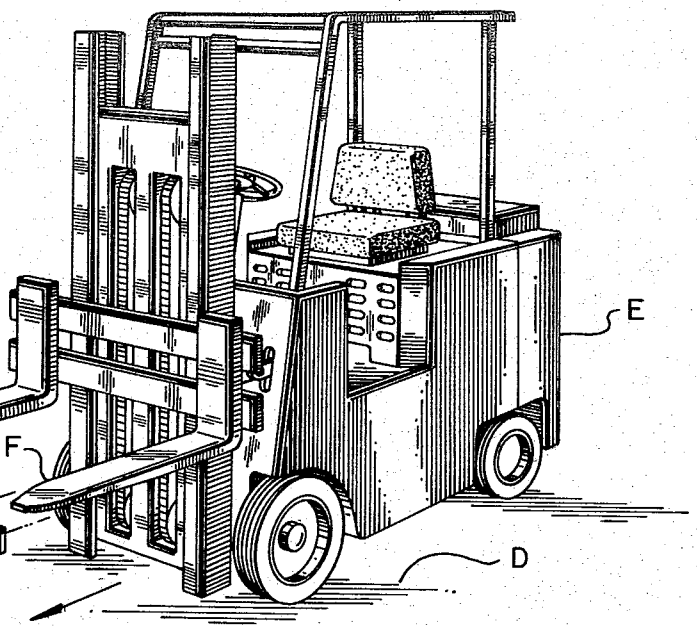
FIG. 1 is a perspective view of a conventional fork lift truck for use with the invention.

FIG. 1 shows a typical fork lift truck resting on warehouse floor D. It is obvious from the construction that the forks cannot be lowered below the level of the floor. FIG. 6 shows a detailed construction of the invention, in which 3 is a horizontal member, preferably a channel, which is slideable into horizontal member 4, a rectangular tube snugly fitting both member 3 and F the forks of the fork lift, over which it is also slideable. It is obvious that member 4 may be of a length which will enable the operator to handle loads at any reasonable distance from the edge of the dock, subject only to the loss of capacity as the forks are further extended from the lift. All members may be of steel, or of alloys of lighter metals. Welded to horizontal member 3 at its outer end is vertical member 2, of a length sufficient to allow the handling of a load from ground level. Member 1, which is also preferably made of a channel, is welded or otherwise attached to the lower end of vertical member 2 at an angle of 90 degrees, and extending forward from the lift. Its nose may be beveled as shown, to facilitate entry into a pallet.

Figure 2:
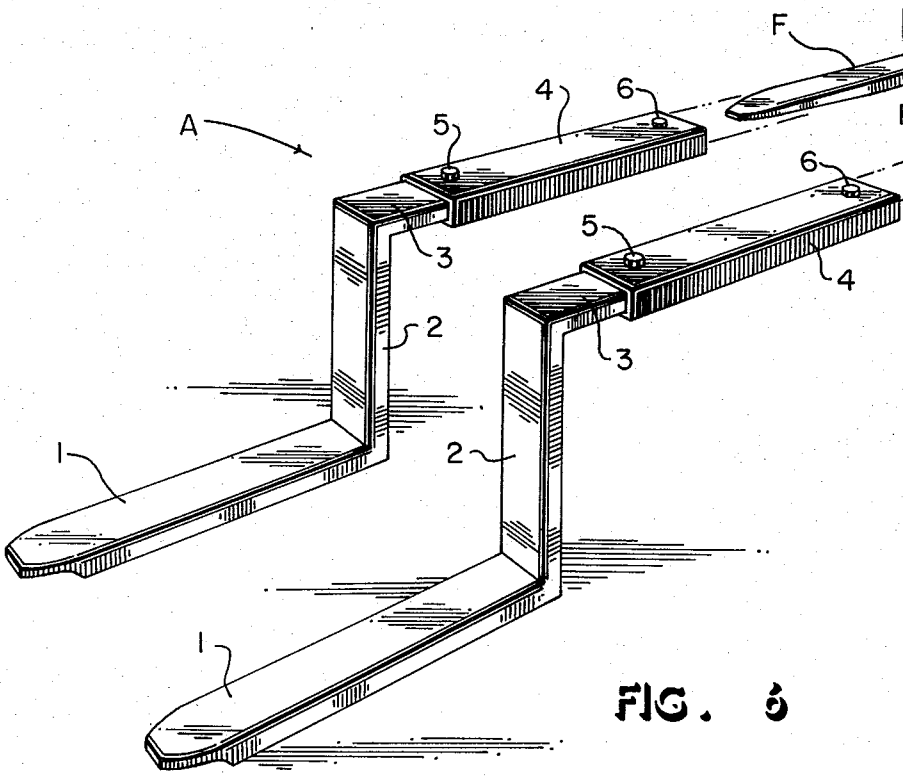
FIGS. 2 through 5 show the successive positions of the fork lift truck with the detachable extensions attached which are involved in the lifting of a load from a level beneath that of the floor on which the truck is operating.
Figure 2:
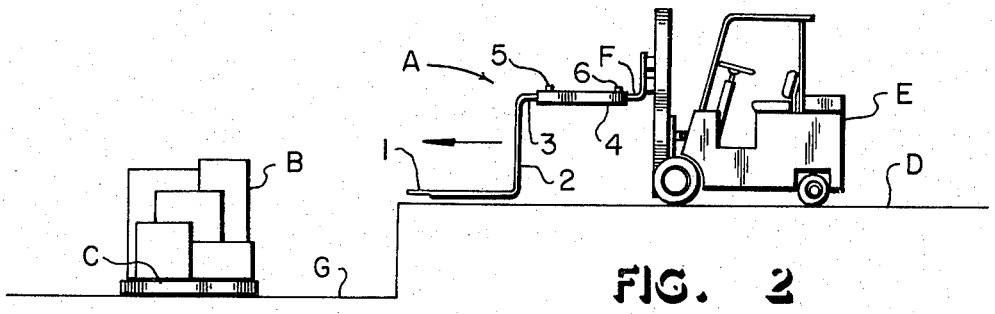
Figure 3:
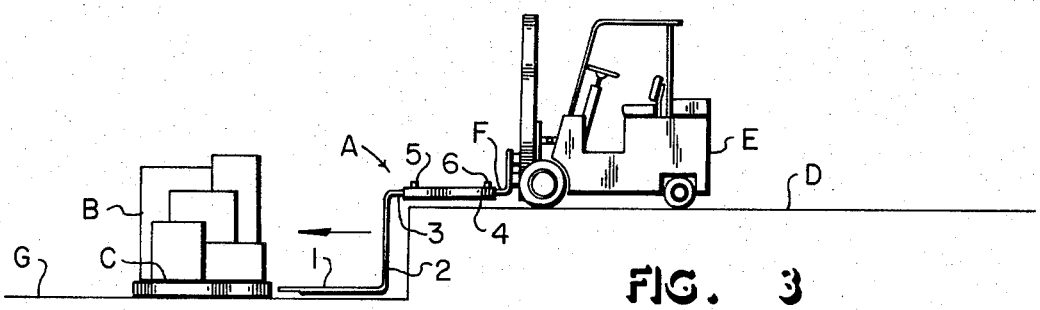
Figure 4:
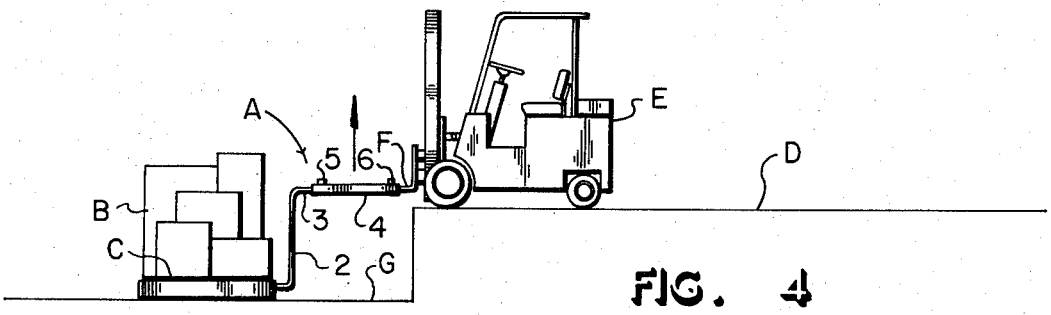
Figure 5:
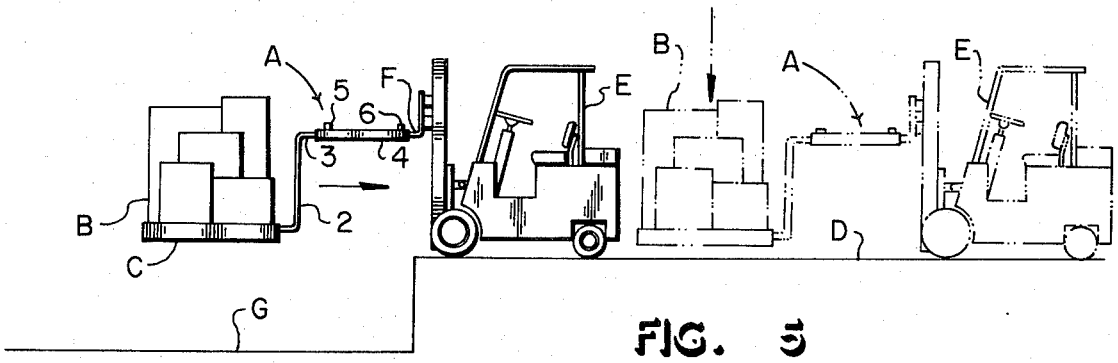

FIGS. 2 through 5 show the invention in use on a fork lift truck. In FIG. 2 the extensions are in place held by bolts or set screws 6 and the truck is resting at a distance from the edge of the dock. In FIG. 3 the truck has advanced somewhat so that the extension forks can be lowered, in this case, to ground level. In FIG. 4 the truck has advanced so that the extension forks have entered pallet C resting on the ground G. It is obvious that the pallet might equally well be resting on the bed of a pick up or trailer at some level intermediate between the ground and the warehouse floor. In FIG. 5 the load B on pallet C has been elevated, and in the dotted lines of the same figure the truck has pulled away from the dock, and pallet C with its load B can now be delivered to any desired location in the warehouse. When placing a load on the bed of a truck or low trailer, or on the ground, the above operation is repeated in reverse order.

When not in use, the entire assembly may be removed from the forks of the lift by loosening screws 6, and stored until needed further.

I claim:

1. In a fork lift truck having wheels supporting the truck from a horizontal floor at one height and including forwardly extending forks adapted for vertical travel from the floor to a height above said floor, the improvement comprising:

a. a modified S-shaped extension removably attached to said forks, b. surrogate forks at the distal end of said extension to engage a load, c. structural means in said extension between said point of attachment to said forks and the point of engagement with a load to position said surrogate forks at a lower level than said floor, whereby a load at said lower level may be lifted to and above said floor level for relocation on said floor by said truck, and wherein d. said modified S-shaped extension includes first horizontal member sections which comprise tubular members that removably and slideably engage said forks, and also slideably engage other members of said extension.

2. In a fork lift truck having wheels supporting the truck from a floor level of a dock, and including horizontally extending forks adapted for vertical travel from said floor level to a specific height above said floor, the improvements comprising:

a. removable extensions attached to said forks and having first multiple piece telescoping horizontal member sections extending a distance forward from said forks and attached thereto in telescoping fashion, and vertical member sections extending downward from said first horizontal member sections, and at right angles thereto, b. and second horizontal member sections extending in the same direction as said first horizontal member sections and at right angles to said vertical member sections, c. said second horizontal member sections comprising forks similar in function to said first named forks, d. whereby said fork lift truck may approach the end of said floor level and lower its forks to approximately the floor level and thereby lower said extension forks to a second level below that of the first named floor level to engage and lift a load from said second level.

3. In a fork lift truck having wheels supporting the truck from a horizontal dock floor at one height, and including forwardly extending forks adapted for vertical travel from the dock floor to a height above said floor, the improvement comprising:

a. modified S-shaped extensions removably attached to said forks, and including vertical member sections, b. surrogate forks at the distal ends of said extensions to engage a load, c. structural means in said extensions between the point of attachment to said forks and the point of engagement with said load to position said surrogate forks at a lower level than said dock floor, whereby said load at said lower level may be lifted to and above said dock floor level for relocation on said dock floor by said truck, and wherein d. the height of said vertical member sections is greater than the height of said dock floor above said lower level, whereby said surrogate forks, by directly following the movement of and replacing the function of the first named forks, may be lowered beneath to lift a pallet load resting on said lower level.

4. In a lift fork truck as in claim 3, having separate, individual, independent S-shaped extension members comprising said surrogate forks attached to said truck forks for engaging said pallet load at said lower level.

* * * * *